United States Patent [19]

Pleasants et al.

[11] Patent Number: 5,012,871

[45] Date of Patent: May 7, 1991

[54] FLUID FLOW CONTROL SYSTEM, ASSEMBLY AND METHOD FOR OIL AND GAS WELLS

[75] Inventors: Charles W. Pleasants, Carrollton, Tex.; David R. Burnett; Donald W. Head, both of Kuala Belait, Brunei

[73] Assignee: Otis Engineering Corporation, Carrollton, Tex.

[21] Appl. No.: 508,895

[22] Filed: Apr. 12, 1990

[51] Int. Cl.[5] ..... E21B 23/00; E21B 33/124; E21B 34/14

[52] U.S. Cl. ..... 166/386; 166/127; 166/147; 166/185; 166/191; 166/332; 166/387

[58] Field of Search ..... 166/373, 381, 386, 387, 166/191, 185, 332, 384, 125, 147, 127, 237, 240

[56] References Cited

U.S. PATENT DOCUMENTS

| | | | |
|---|---|---|---|
| 1,927,836 | 9/1933 | Kightlinger | 255/27 |
| 2,499,695 | 3/1950 | Storm | 255/27 |
| 2,828,822 | 4/1958 | Greer | 166/178 |
| 2,851,110 | 9/1958 | Greer | 166/178 |
| 2,901,045 | 8/1959 | Schramm | 166/332 |
| 3,051,239 | 8/1962 | Dollison | 166/125 |
| 3,051,243 | 8/1962 | Grimmer et al. | 166/224 |
| 3,079,996 | 3/1963 | Tamplen | 166/185 |
| 3,088,533 | 5/1963 | Sutliff | 175/297 |
| 3,208,531 | 9/1965 | Tamplen | 166/125 |
| 3,393,002 | 7/1968 | Woolley | 294/86.23 |
| 3,405,773 | 10/1968 | Sutliff et al. | 175/297 |
| 3,944,273 | 3/1976 | Ahlstone | 294/86.1 |
| 3,946,819 | 3/1976 | Hipp | 175/296 |
| 3,949,821 | 4/1976 | Raugust | 175/297 |
| 4,093,294 | 6/1978 | Taylor | 294/86.25 |
| 4,161,224 | 7/1979 | Hostrup | 175/297 |
| 4,179,002 | 12/1979 | Young | 175/297 |
| 4,181,186 | 1/1980 | Blanton | 175/297 |
| 4,185,865 | 1/1980 | Taylor | 294/86.3 |
| 4,186,807 | 2/1980 | Sutliff et al. | 175/302 |
| 4,346,770 | 8/1982 | Beck | 175/297 |
| 4,396,061 | 8/1983 | Tamplen et al. | 166/217 |
| 4,436,150 | 3/1984 | Barker | 166/131 |
| 4,515,220 | 5/1985 | Sizer et al. | 166/384 |
| 4,558,895 | 12/1985 | Tamplen | 294/86.18 |
| 4,612,984 | 9/1986 | Crawford | 166/77 |
| 4,614,233 | 9/1986 | Menard | 166/240 |
| 4,625,799 | 12/1986 | McCormick et al. | 166/223 |
| 4,646,830 | 3/1987 | Templeton | 166/178 |
| 4,682,657 | 7/1987 | Crawford | 166/385 |
| 4,685,516 | 8/1987 | Smith et al. | 166/65.1 |
| 4,708,208 | 11/1987 | Halbardier | 166/387 |
| 4,715,445 | 12/1987 | Smith, Jr. | 166/377 |
| 4,759,406 | 7/1988 | Smith et al. | 166/65.1 |
| 4,767,145 | 8/1988 | Bullard | 294/86.18 |
| 4,793,417 | 12/1988 | Rumbaugh | 166/312 |
| 4,794,989 | 1/1989 | Mills | 166/191 |
| 4,796,707 | 1/1989 | Halbardier | 166/387 |
| 4,805,699 | 2/1989 | Halbardier | 166/387 |
| 4,844,166 | 7/1989 | Going, III et al. | 166/379 |
| 4,862,958 | 9/1989 | Pringle | 166/72 |
| 4,869,325 | 9/1989 | Halbardier | 166/387 |
| 4,915,175 | 4/1990 | Mashaw, Jr. | 166/240 |
| 4,928,772 | 5/1990 | Hopmann | 166/332 |

FOREIGN PATENT DOCUMENTS

| | | |
|---|---|---|
| 8400577 | 2/1984 | PCT Int'l Appl. . |
| 2089400 | 11/1981 | United Kingdom . |

*Primary Examiner*—Bruce M. Kisliuk
*Attorney, Agent, or Firm*—Warren B. Kice

[57] ABSTRACT

A fluid flow control system, assembly and method for wells in which a sliding sleeve valve is connected in a string of well tubing in a wellbore casing. The sliding sleeve valve functions to selectively control the lateral flow of fluid through the assembly into the annulus between the assembly and the wellbore casing. A straddle assembly is locked within the sleeve valve assembly for isolating a lateral flow path. A stinger assembly is provided which receives reeled tubing and is insertable to lock within the straddle assembly to create a flow path between the reeled tubing and exterior of the sleeve valve.

46 Claims, 5 Drawing Sheets

FLUID FLOW CONTROL SYSTEM, ASSEMBLY AND METHOD FOR OIL AND GAS WELLS

BACKGROUND OF THE INVENTION

The present invention relates to a fluid flow control system, assembly and method and, more particularly, to a system, assembly and method utilizing reeled tubing for controlling the flow of fluid in oil and gas earth wells.

In the operation of subterranean oil and gas earth wells, it is often necessary to control the flow of fluid through the production tubing and into the annulus between the tubing and the wellbore casing. For example, in stimulation techniques the wellbore casing passes through a formation in the earth well and a pressurized fluid is passed through the production tubing and then laterally through appropriate openings formed in the tubing into the annulus between the tubing and the wellbore casing. Perforations are provided in the latter casing for directing the fluid into the formation for stimulating the recovery of oil and gas.

Known techniques of this nature employ threaded tubing for selective conveying of the fluid from the ground surface to the perforated casing. Although reeled tubing has been used in connection with production tubing to perform other functions there has been no known effective use of reeled tubing for conveying stimulation fluid into the annulus between the production tubing and the casing probably due to the need for relatively sophisticated high pressure sealing and blowout prevention techniques. There is a need for reeled tubing in these types of operations since the reeled tubing has several advantages. For example, it can be more rapidly inserted into the well and can be more easily passed through downhole equipment. Also, the reeled tubing can traverse highly deviated, or horizontal, wells which could otherwise not be traversed with wireline or threaded tubing in a controlled manner.

SUMMARY OF THE INVENTION

It is therefore an object of the present invention to provide a fluid flow control system, assembly and method for oil and gas wells.

It is a further object of the present invention to provide a system, assembly and method of the above type which is adapted for use with reeled tubing.

It is a still further object of the present invention to provide a system, assembly and method of the above type in which the flow of the fluid from the reeled tubing can be selectively controlled.

It is a still further object of the present invention to provide a system, assembly and method of the above type in which can be used in vertical, deviated, or horizontal wells.

It is a still further object of the present invention to provide a system, assembly and method of the above type which can be used to perform stimulation, injection or formation testing operations using reeled tubing.

Toward the fulfillment of these and other objects, the assembly of the present invention uses a sliding sleeve valve connected in a string of well tubing which is inserted in the wellbore casing. A straddle assembly is provided within the sliding sleeve valve for sealing against axial flow of fluid and isolating a lateral fluid flow path. A stinger assembly is provided which receives reeled tubing, is insertable within the straddle assembly and functions to lock the stinger assembly and reeled tubing relative to the straddle assembly and the sleeve valve. The sliding sleeve valve functions to selectively control the lateral flow of stimulation or formation testing fluid through the assembly into the annulus between the assembly and the wellbore casing.

DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1A:
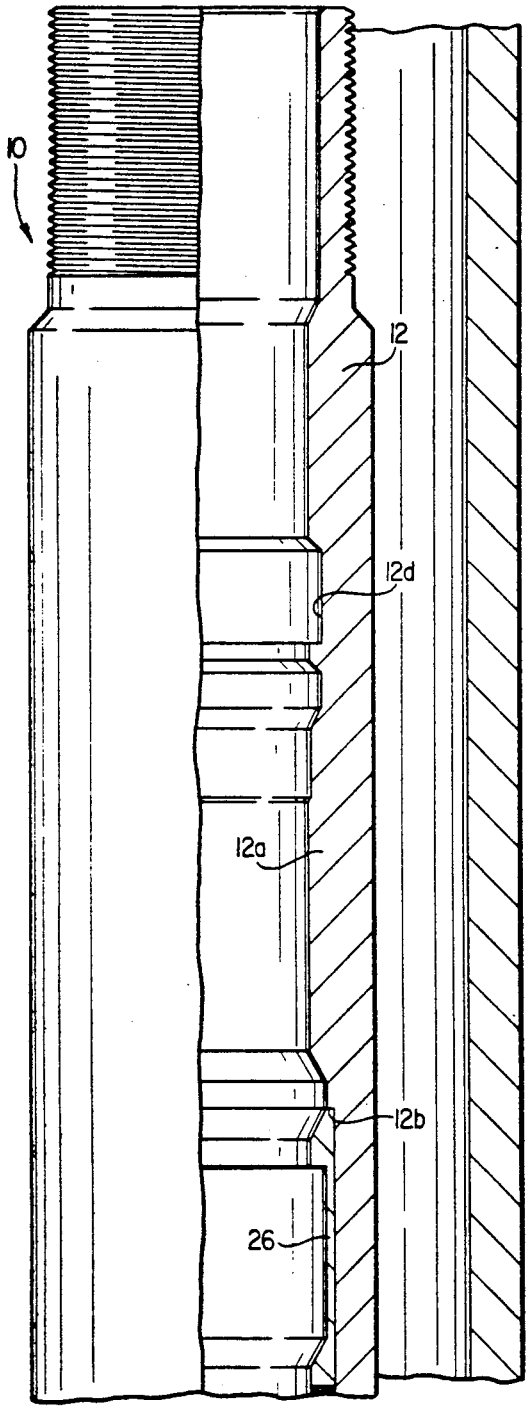
FIGS. 1A–1C are longitudinal sectional views of the sliding sleeve valve of the present invention with FIG. 1B being a downward continuation of FIG. IA and FIG. 1C being a downward continuation of FIG. 1B.
Figure 1B:
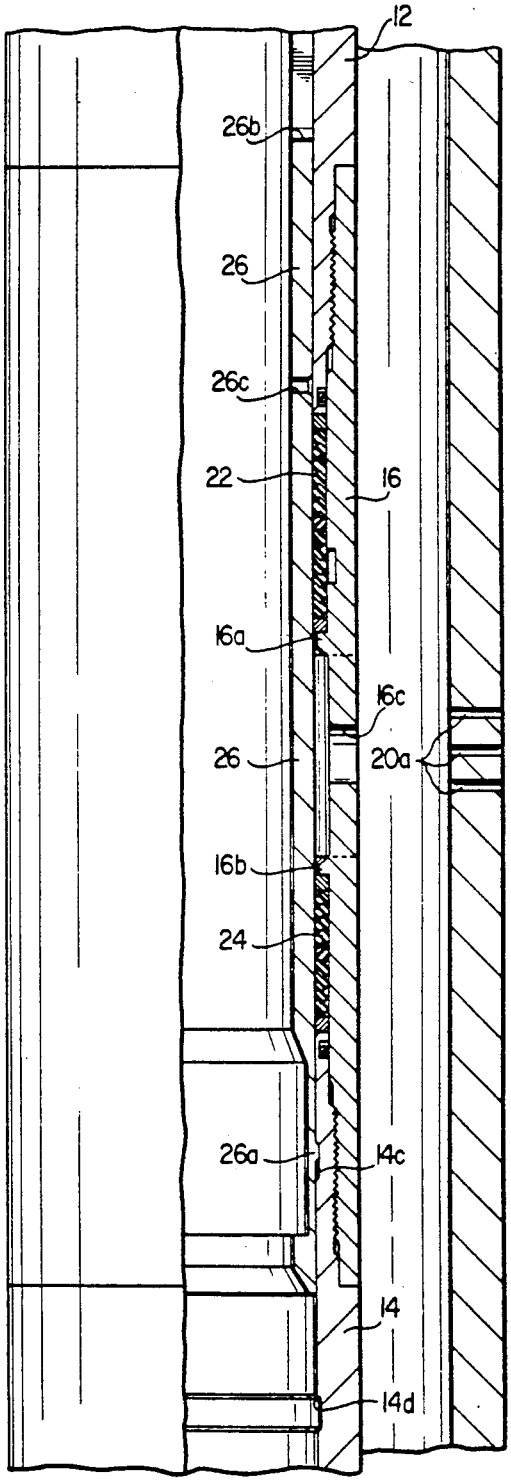
Figure 1C:
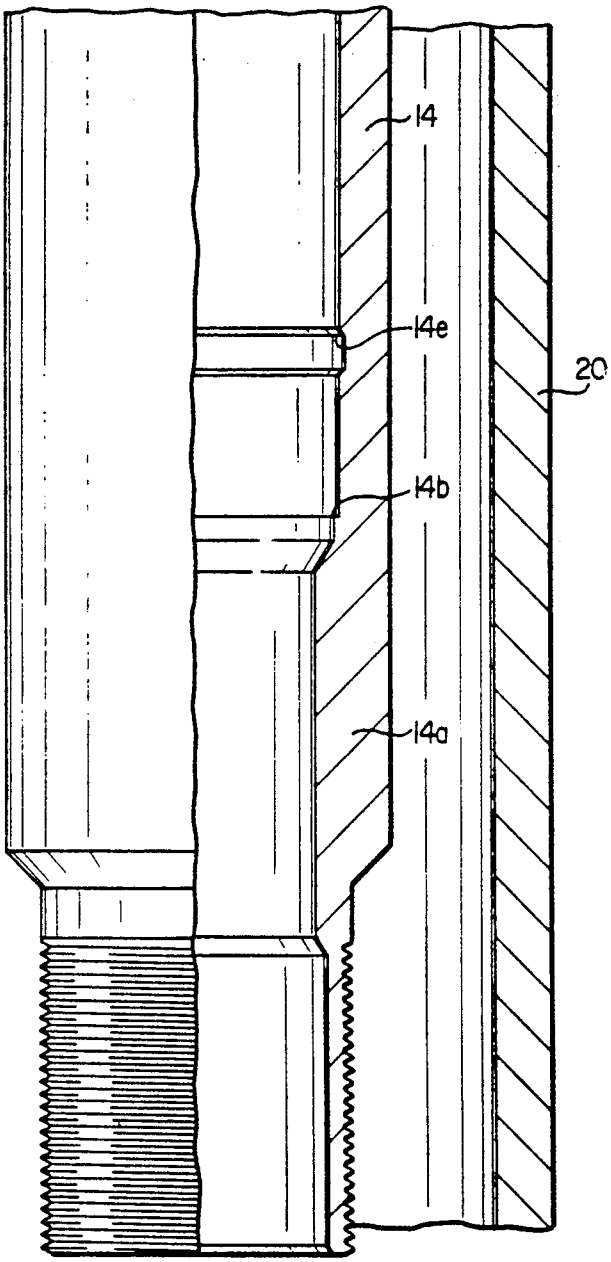

Referring to FIGS. 1A–1C, the reference numeral 10 refers in general to a sliding sleeve valve comprising an upper tubular housing 12 and a lower tubular housing 14 each of which has a stepped outer diameter and inner diameter. An intermediate tubular housing 16 extends between the upper housing 12 and the lower housing 14. The upper and lower end portions of the upper housing 12 are stepped and are provided with a plurality of external threads to enable the upper end portion to be connected in a string of well tubing (not shown) and to enable the lower end portion to receive and engage an overlapping threaded upper end portion of the intermediate housing 16. Similarly, the lower end portion of the intermediate housing 16 is in threaded engagement with the upper end portion of the lower housing 14 and the lower end portion of the latter housing is externally threaded for connection in the string of well tubing, as will be described.

The valve 10 is positioned relative to a wellbore casing 20 located in an earth well and having a plurality of axially and angularly spaced perforations 20*a*. As described in detail later, the valve 10 is normally connected between two sections of production tubing (not shown), and packers, or the like, are spaced above and below the valve 10 to isolate zones in the casing 20 for selective stimulation of the oil and gas reservoirs adjacent the casing or for other similar functions.

An annular packing 22 extends between the lower end of the upper housing 12 and an inwardly directed annular flange 16*a* formed on the intermediate housing 16. Similarly, an annular packing 24 extends between the upper end of the lower housing 14 and another inwardly-directed annular flange 16*b* formed on the intermediate housing 16 in a spaced relation to the flange 16*a*. A plurality of angularly-spaced openings 16*c* (one of which is shown) are provided through the intermediate housing 16 and extend between the packings 22 and 24.

The inner bores of the upper housing 12 and the lower housing 14 ar shown by the reference numerals 12*a* and 14*a*, respectively and are stepped to define a pair of shoulders 12*b* and 14*b* and a continuous enlarged bore extending therebetween. The latter bore receives a sliding sleeve 26 the outer diameter of which is slightly less than the inner diameter of the enlarged bore and the packings 22 and 24. The sleeve 26 is adapted for slidable movement between a closed position shown in FIGS. 1A–1C, in which the upper end of the sleeve 26 engages the shoulder 12*b*, and an open position (shown and further described in connection with FIGS. 2A–2D) in which the lower end of the sleeve 26 engages the shoulder 14*b*.

Three axially spaced annular detents 14*c*, 14*d* and 14*e* are provided in the inner surface of the lower housing 14 and are adapted to be engaged by an annular raised portion 26*a* formed on the outer surface of the sleeve 26. In the closed portion of FIGS. 1A–1C the raised portion 26*a* extends in the detent 14*c*.

A plurality of angularly-spaced openings 26*b* (one of which is shown) are provided through the sleeve 26 which, in the closed position of FIG. 1, are axially-spaced from the openings 16*c* in the intermediate housing 16. Similarly, a plurality of angularly spaced, relatively small-diameter passages 26*c* are provided through the sleeve 26 for reasons to be described.

The sliding sleeve valve 10 is located in the string of well tubing and relative to the casing 20 so that the openings 16*c* are axially aligned with the perforations 20*c* in the casing.

FIGS. 2A–2D depict the entire fluid control assembly of the present invention, including the sliding sleeve valve 10, mounted in the casing 20. After the valve 10 is positioned in the casing 20 in the location described above, the sleeve 26 is moved downwardly to its open position in a manner to be described. A tubular straddle isolation assembly 30 is then inserted in the bore of the valve 10 in a coaxial relation thereto also in a manner to be described. The straddle assembly 30 includes an upper locking mandrel assembly 32, a straddle mandrel 34 connected to the lower end of the mandrel 32, a packing sub 36 connected to the lower end of the straddle mandrel 34, an equalizer sub 38 connected to the lower end of the packing sub 36 and a cap 40 connected to the lower end of the equalizer sub 38.

All of these components making up the straddle assembly 30 are tubular and thus define a continuous bore which is closed at its lower end by the cap 40. Also, all of these components have stepped inner and outer surfaces and their respective end portions are in a telescoping, or overlapping, relationship and are connected together by cooperating internal and external threads respectively provided thereon and O-ring seals extending therebetween. Since these type of connections are conventional they will not be described in any further detail.

The locking mandrel assembly 32 includes a fishing neck 42 having an enlarged end portion 42*a* and an expander sleeve 44 in threaded engagement with the lower end portion of the fishing neck. A portion of the expander sleeve 44 extends within the upper end portion of a locking sleeve 46 having three angularly-spaced elongated openings, or windows, 46*a* (only one of which is shown). Each of the windows 46*a* receives a locking key 48 having a stepped outer surface which, in the locking position shown, extends through its respective window and into corresponding grooves 12*c* and 12*d* formed in the inner bore of the upper housing 12. It is understood that three leaf springs (not shown) are provided between the expander sleeve 44 and the locking sleeve 46 and that each leaf spring is bent so that its upper portion extends radially in a slot (not shown) formed in the locking sleeve 4 and its lower end portion extends underneath a corresponding key 48 to urge the keys radially outwardly into the locking position shown. The expander sleeve 44 can then be moved downwardly to the position shown to lock the keys 48 in the locking position shown. A retainer sleeve 50, having a stepped outer surface, receives the expander sleeve 44, the locking sleeve 46 and the keys 48, and is connected, at its lower end portion, to the straddle mandrel 34.

Since the locking mandrel 32 is conventional and is more specifically described in U.S. Pat. No. 3,208,531, assigned to the same assignee as the present invention, it will not be described in any further detail.

An annular packing 54 extends between a shoulder defined by the stepped outer surface of the sleeve 50 and the upper end of the straddle mandrel 34, and an annular packing 56 extends between a shoulder defined by a stepped outer surface of the packing sub 36 and the upper end of the equalizer sub 38. The packings 54 and 56 are designed to provide a tight fit with the corresponding surface of the side door valve 10 to withstand and seal against relatively high fluid pressures.

A plurality of angularly-spaced openings 34*a* (one of which is shown) are provided through the mandrel 34 which are in axial alignment with the openings 16*c* in the housing 16 of the side door valve 10 and with the openings 26*b* of the sleeve 26 in the open position of the sleeve shown in FIG. 2.

A plurality of angularly-spaced, radially-extending indexing pins 58 (one of which is shown) extend through an opening in the straddle mandrel 34 in threaded engagement therewith. The pins 58 project inwardly into the bore of the mandrel 34 and their function will be described later.

The equalizer sub 38 has a radial passage 38*a* extending therethrough which is normally blocked by an equalizer valve 59 having two spaced O-rings 59*a* and 59*b* engaging the inner bore of the sub. A plurality of slots are formed in the lower end of the valve 59 to form resilient fingers 59*c* which normally rest on a beveled internal shoulder 38*b* of the sub 38.

The reference numeral 60 refers, in general, to a tubular stinger assembly having a portion extending within the bore of the straddle assembly 30. The upper portion of the stinger assembly 60 includes an upper housing 62 having an internally threaded upper end portion for connection to reeled tubing (not shown). The housing 62 extends over an inner mandrel 64 having a chamfered end 64*a* and an annular groove 64*b*. A plurality of shear pins 65 (one of which is shown) extend through angularly-spaced openings formed through the upper housing 62 and into an annular groove formed in the outer surface of the inner mandrel 64 to normally prevent relative axial movement between the housing and the mandrel.

A valve housing 66 extends over the lower end portion of the upper housing 62, and a plurality of angularly-spaced retaining lugs 68 (one of which is shown)

extend from the inner mandrel 64, through corresponding openings found in the upper housing 62 and into an annular groove formed in the inner surface of the valve housing 66. The lugs 68 normally prevent axial movement of the upper housing 62 relative to the valve housing 66 but permit an emergency release of same as will be described. A ball valve 69 is sized to rest on the chamfered end 64*a* of the inner mandrel 64 for reasons to be described.

Figure 2A:
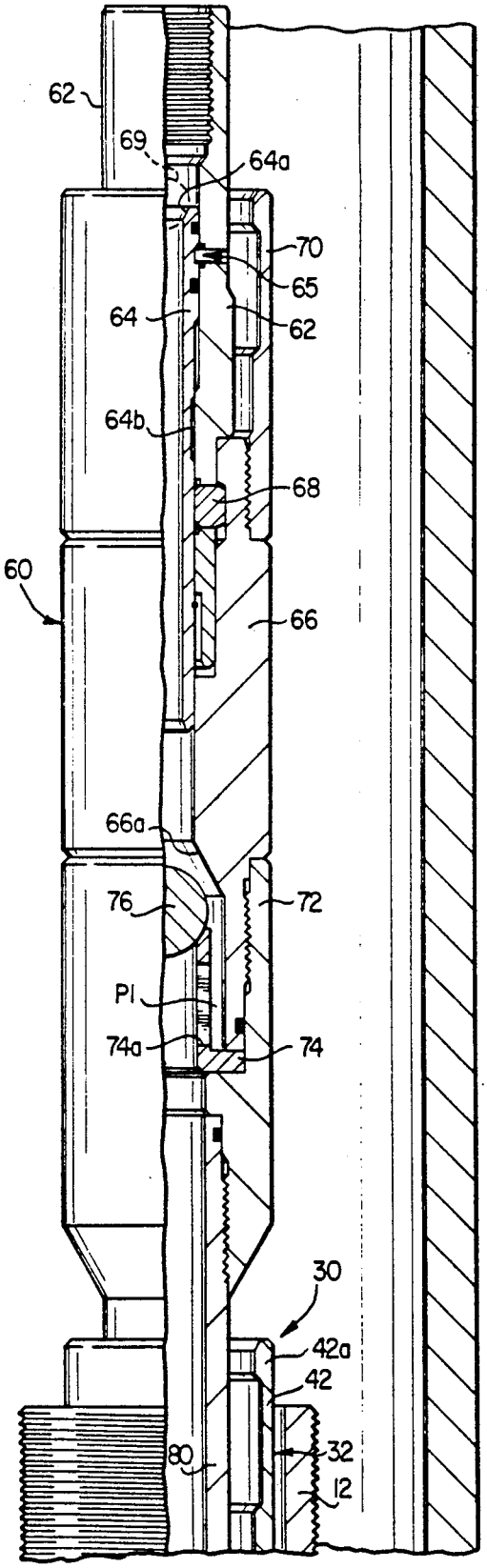
FIGS. 2A–2D are longitudinal sectional views of the entire flow control assembly of the present invention inserted in a wellbore casing with FIG. 2B being a downward continuation of FIG. 2A, FIG. 2C being a downward continuation of FIG. 2B, and FIG. 2D being a downward continuation of FIG. 2C.
Figure 2B:
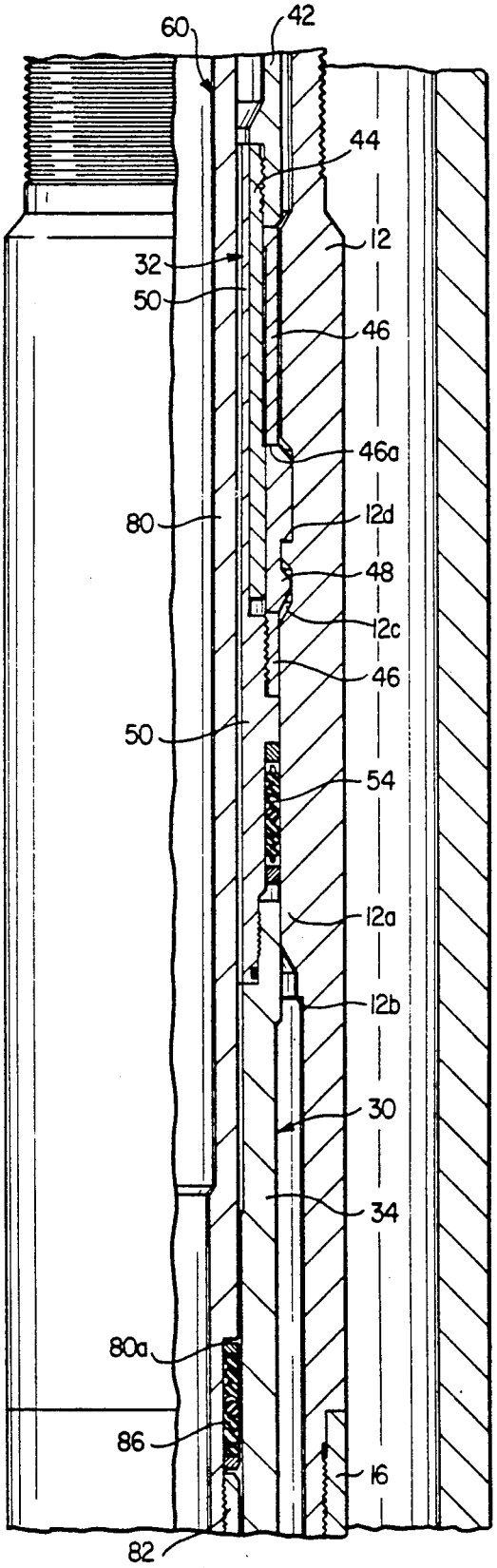
Figure 2C:
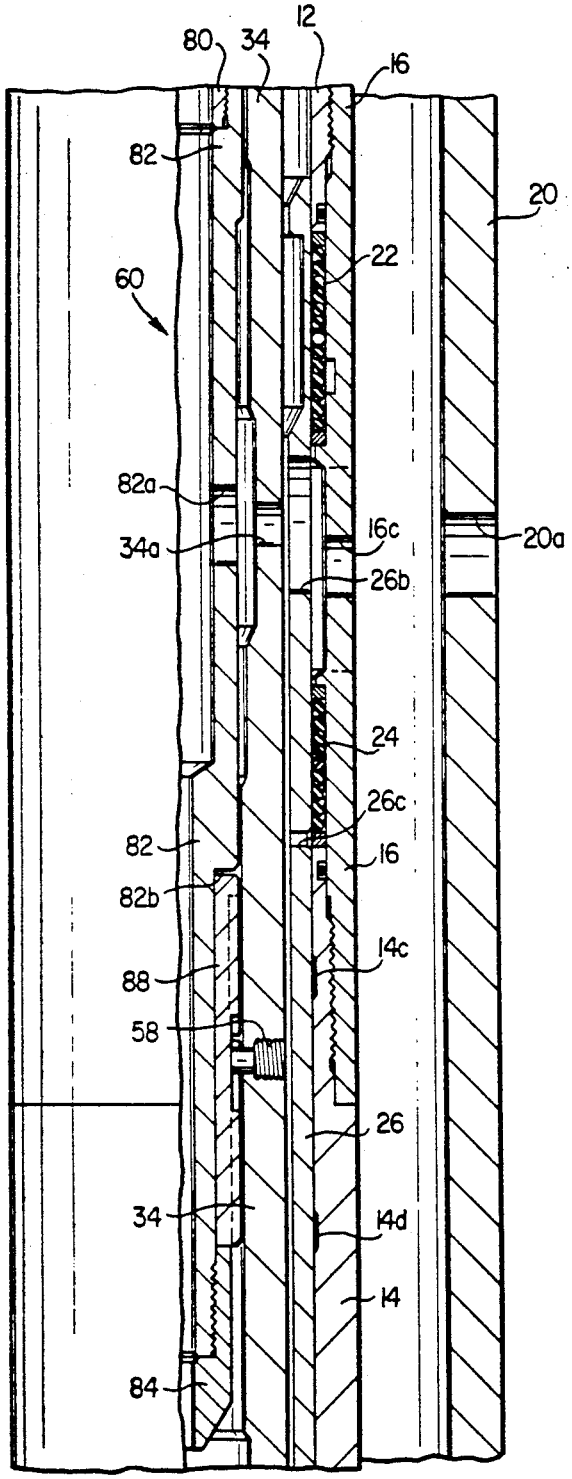

A fishing neck 70 projects upwardly from the valve housing 66 with its lower end portion in threaded engagement with the upper end portion of the latter housing. The upper end portion of a cross over sub 72 is in threaded engagement with the lower end position of the valve housing 66, and a valve cage 74 is secured between the lower end of the valve housing 66 and a shoulder formed by a stepped inner surface of the cross-over sub 72. The body portion of the valve cage 74 is spaced slightly radially outwardly from the corresponding inner surface of the valve housing 66 to define an annular passage P1 and a plurality of openings 74*a* (one of which is shown in FIG. 2*a*) in communication with the latter passage. The upper end of the valve cage 74 is chamfered for receiving a ball valve 76 which moves between the latter end and a beveled shoulder 66*a* formed on the inner surface of the valve housing, for reasons that will be explained.

The stinger assembly 60 also includes a packing sub 80 connected to the lower end portion of the cross-over sub 72, a circulating sub 82 connected to the lower end of the packing sub and a retainer cap 84 extending over the lower end portion of the circulating sub. All of these components are tubular, have stepped inner and outer surfaces, and their respective end portions are in a telescoping, or overlapping relationship and are connected together by cooperating internal and external threads respectively provided thereon. Since these types of connections are conventional they will not be described in any further detail.

An annular packing 86 is located between the upper end of the circulating sub 82 and a shoulder 80*a* formed on the packing sub 80. A plurality of annular-spaced openings 82*a* (one of which is shown) extend through the sub in axial alignment with the openings 34*a* of the mandrel 34, the openings 16*c* in the housing 16 of the sliding sleeve valve 10, and with the openings 26*b* of the sleeve 26 in its open position.

An indexing sleeve 88 extends between the upper end of the cap 84 and a shoulder 82*b* defined by the stepped outer surface of the sub 82. The inner diameter of the sleeve 88 is slightly greater than the outer diameter of the corresponding portion of the sub 82, and the outer diameter of the sleeve is slightly less than the corresponding portion of inner diameter of the mandrel 34 to permit rotation of the sleeve for reasons to be described.

Figure 3:
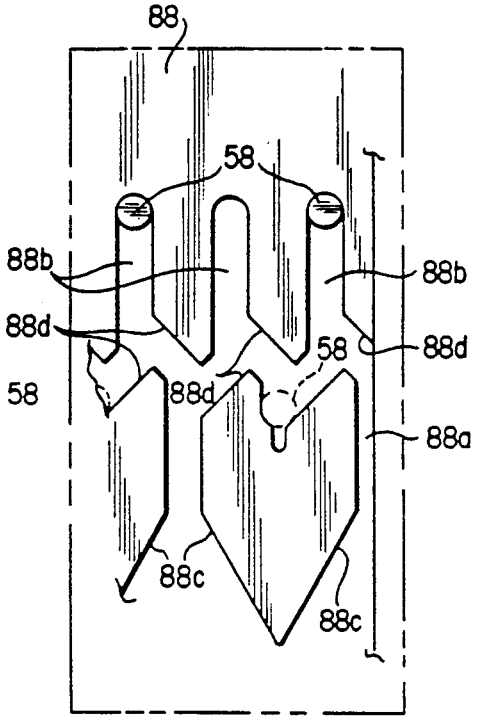
FIG. 3 is a developed view of the indexing sleeve of the control assembly of the present invention.

As shown in FIG. 3, a plurality of slots 88*a* are provided in the lower portion of the sleeve 88 which receive the indexing pins 58 and a plurality of slots 88*b* are provided in the upper portion of the sleeve 88. The sleeve 88 also includes angled cam surfaces 88*c* and 88*d* located adjacent the slots 88*a* and 88*b*, respectively, for reasons to be described. During downward movement of the sleeve 88 relative to the pins 58, the pins engage the lower cam surfaces 88*c*, work their way into the grooves 88*a* (by rotation of the sleeve 88 as necessary), engage the upper cam surfaces 88*d* and work their way into, and pass through, the grooves 88*b* until the lower end of the housing 72 bottoms out on the upper end of the fishing neck 42. Upon subsequent upward movement of the sleeve 88, the pins pass back through the grooves 88*b*, engage the cam surface 88*d* to cause rotation and orientation of the sleeve 88, and bottom out on the lower ends of the latter grooves, as shown by the dashed lines. This locks the sleeve 88, and therefore the assembly 60, against further upward axial movement relative to the assembly 30. Since this locking technique utilizing this pin groove arrangement is conventional as shown, for example, in U.S. Pat. No. 4,321,965, assigned to the assignee of the present invention, it will not be described in any further detail.

Figure 4:
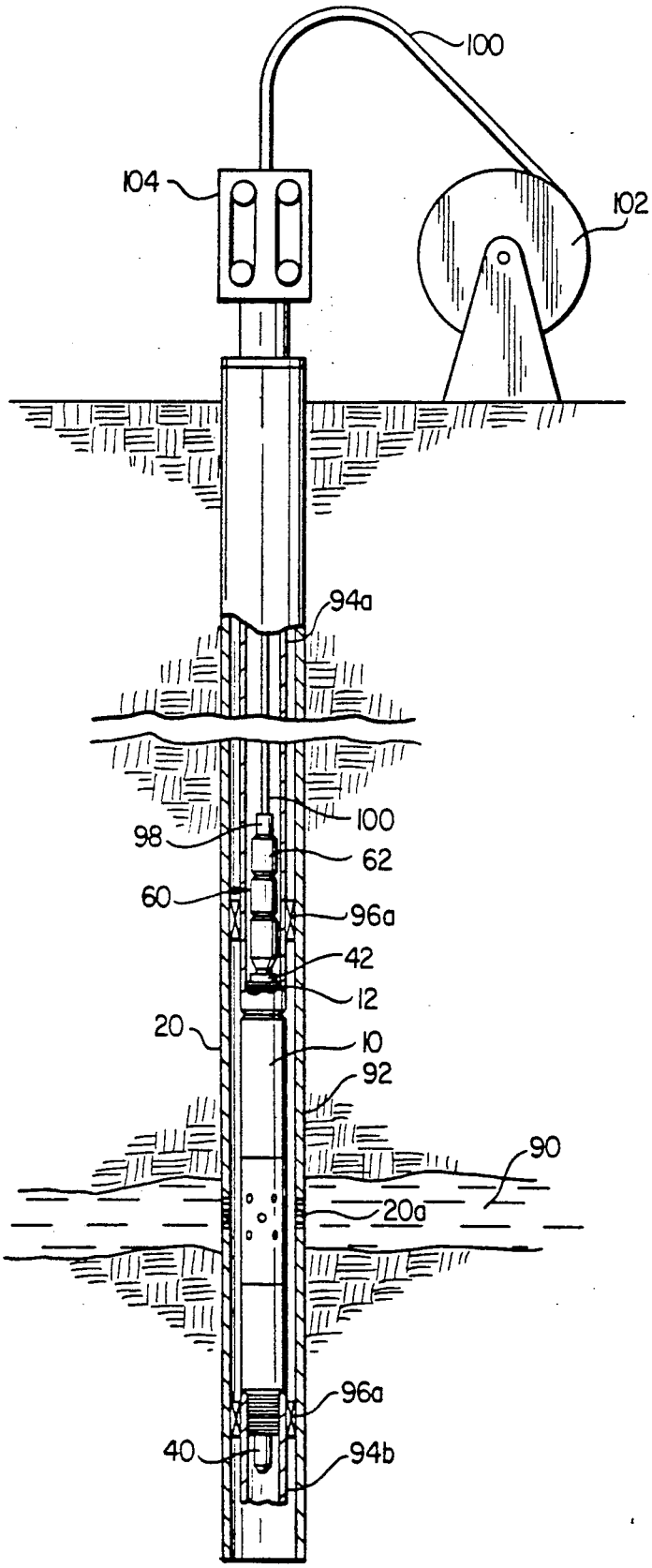
FIG. 4 is a schematic view, partially in elevation and section, and partially broken away, of an earth well, showing the system and assembly of the present invention installed in a wellbore casing.

The casing 20 is shown in FIG. 4 passing through a formation 90 in an earth well 92. The reference numerals 94*a* and 94*b* refer to an upper section and a lower section, respectively, of a string of well tubing located in the casing 20. The sliding sleeve valve 10 is connected between the tubing sections 94*a* and 94*b* in the manner described above.

Two axially spaced packers 96*a* and 96*b* extend between the outer surfaces of the well tubing sections 94*a* and 94*b*, respectively, and the inner surface of the casing 20. The packers 96*a* and 96*b* operate in a conventional manner to anchor and seal the tubing sections 94*a* and 94*b* to the casing 20 to form a sealed annular chamber and isolate the perforations 20*a* in the casing 20 from other axially spaced perforations (not shown) formed through the casing. In this manner, the fluid stimulation operation to be described can be applied to the perforations 20*a*.

In FIG. 4, the straddle assembly 30 is positioned in the sliding sleeve valve 10 in the manner described above, and the stinger assembly 60 is shown after it has been lowered into the straddle assembly 30. To the latter end, the upper end of the stinger assembly 60 is connected, via an adapter 98 to the lower end of a section of reeled tubing 100 which is stored on a reel 102 above ground and is injected into the casing 20 by an injector 104. It is understood that a manifold (not shown) is provided which includes the necessary pumps, valves, and fluid reservoirs to discharge high pressure stimulation fluid into and through the reeled tubing 100. It is also understood that a wellhead valve (not shown) is used to control vertical access to and fluid communication with the upper well tubing section 94*a* and blowout preventers, or the like (not shown), can be installed to block fluid flow during emergency conditions. Since these components are conventional they will not be discribed in any further detail.

Figure 2D:
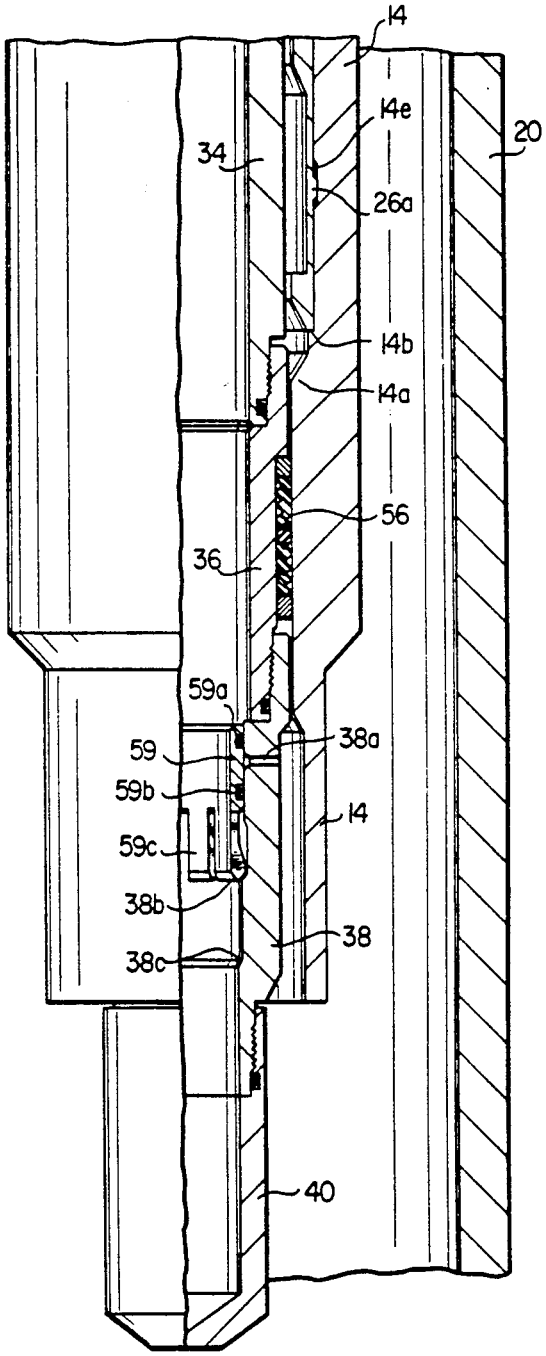

In operation, the sliding sleeve valve 10 is connected between the two well tubing sections 94*a* and 94*b* and the assembly is positioned in the wellbore casing 20, as shown in FIG. 4, i.e., with the openings 16*c* of the valve 10 in approximate axial alignment with the perforations 20*a* in the casing 20. The sleeve 26 of the valve 10 is in its closed position shown in FIG. 1B, i.e., with the raised portion 26*a* of the sleeve 26 in the detent 14*c*, and the openings 26*b* axially-spaced from the openings 16*c* in the intermediate housing 16. A shifting tool, or the like (not shown), is inserted into the casing 20 by reeled tubing or wireline and is lowered until it extends within the side door valve 10. An example of such a shifting tool is disclosed in U.S. Pat. No. 3,051,243, the disclosure of which is incorporated by reference. The shifting tool is adapted to engage the sleeve 26 in a conventional manner and the tool is then moved downwardly relative into the side door valve 10 to slide the sleeve downwardly. This downward movement of the sleeve 26 continues until the raised portion 26*a* engages in the detent 14*e* and the lower end of the sleeve abutts the shoulder 14*b* of the housing 14 as shown in FIG. 2D. In this position, the openings 26*b* of the sleeve 26 are in axial alignment with the openings 16*c* of the intermediate housing 16.

The straddle assembly 30 is then connected, above surface, to a suitable running tool, or the like (not shown), the upper end of which is connected to a section of reeled tubing (which may be reeled tubing 100) and the lower end of which is adapted to be quick releasably connected to the fishing neck 42. The running tool can be of the type disclosed in co-pending application Ser. No. 417,282, filed Oct. 5, 1989, and assigned to the assignee of the present invention. The running tool, and therefore the straddle assembly 30, is then inserted into the casing 20 as disclosed in the above-identified application. A prong (not shown) associated with the running tool initially enters the straddle assembly 30 and passes through the bore thereof until it engages the upper end of the equalizer valve 59 and forces it downwardly, which causes the shoulder 38*b* formed on the equalizer sub 38 to cam the fingers 59*c* radially inwardly to permit the valve to continue to move downwardly until the lower ends of the fingers engage an internal shoulder 38*c* of the sub 38. This slideable movement of the valve 59 exposes the opening 38*a*, and thus permits any well fluid to flow through the latter opening into the interior of the equalizer sub 38 and pass upwardly through the bore of the straddle assembly 30. This fluid can then exit through suitable radial openings (not shown) formed in the fishing neck 42 in order to equalize the pressure across the latter assembly during this downward movement of the assembly 30.

The assembly 30 then enters the inner bore of the valve 10 and continues until it attains the position shown in FIGS. 2A–2D. During this movement, the keys 48 are initially spring biased into the corresponding grooves 12*c* and 12*d*. Upon further movement of the fishing neck 42 and the expander sleeve 44 downwardly, the latter sleeve locks the keys 48 in the position shown and prevents further downward movement of the latter neck and sleeve. In this position, the openings 34*a* in the mandrel 34 are in alignment with the openings 26*b* and 16*c* respectively provided in the sleeve 26 and the housing 16, which openings extend between the packing assemblies 54 and 56.

The equalizer valve 59 can then be moved back, by the above mentioned prong, to the position shown in FIG. 2D, i.e. in a position blocking flow through the passage 38*a* and the prong, along with the above-mentioned running tool, are removed from the wellbore.

As shown in FIG. 4 an end of a section of the reeled tubing 100 is then threaded onto the adapter 98 which is also connected to the housing 62 of the stinger assembly 60. The assembly 60 and the reeled tubing 100 is pushed through the casing 20 and the well tubing section 94*a* until it enters the upper end portion of the straddle assembly 30 and continues until the pins 58 pass into and through the appropriate grooves 88*a* in the sleeve 88. Further movement of the straddle assembly, and therefore the sleeve 88, causes the pins 58 to engage the cam surfaces 88*d* to rotate the sleeve into proper orientation until the pins enter and engage the upper end portions of the grooves 88*b* as shown by the solid lines in FIG. 3, as described above. It is noted that, just prior to the pins 58 engaging the surfaces defining the upper ends of the grooves 88*b*, the lower end of the crossover sub 72 contacts the upper end 42*a* of the fishing neck 42 to eliminate damage to the pins 58.

The operator then pulls up on the reeled tubing 100 and therefore the stinger assembly 60 and the sleeve 88, which causes the pins 58 to move out of the grooves 88*b* and take the position shown by the dashed lines in FIG. 3, i.e. with the pins engaging the apex of each of the cam surfaces 88*d* to lock the stinger assembly 60 against further upward axial movement relative to the straddle assembly 30. In this position of the stinger assembly 60, the openings 82*a* are in alignment with the openings 34*a*, 26*b* and 16*c* as show in FIG. 2C.

Pressurized stimulation fluid can then be introduced, via the reeled tubing 100, through the bore of the stinger assembly 60. Flow through the assembly is blocked by the end cap 40 of the straddle assembly 30 and the packings 54, 56 and 86. Thus, the fluid passes radially through the aligned openings 82*a*, 34*a*, 26*b* and 16*c* before discharging into the annulus defined between the outer surface of the side door valve 10 and the inner surface of the casing 20. The fluid then will pass through the perforations 20*a* and into the formation 90 to stimulate same.

During the above operation, the ball valve 76 is forced against the end of the cage 74 by the stimulation fluid as it passes around the ball and through the opening 74*a*. In the event the well fluid pressure becomes excessive to the extent that it flows upwardly through the bore of the stinger assembly 60, the force of this pressure drives the ball valve 76 against the shoulder 66*a* to block any further flow upwardly, and thus prevent possible backflow towards the surface. Of course, in situations in which it is desired to permit the backflow of well fluid from the formation, through the aligned openings 16*c*, 26*b*, 34*a* and 82*a*, into the bore of the stinger assembly 60 and to the reeled tubing 100 for passage to the surface, the valve 76 is not used.

In the event it is necessary to effect an emergency release of the reeled tubing 100 from the stinger assembly 60, the ball valve 69 is dropped into the reeled tubing and is forced against the end 64 *a*of the inner mandrel 64 under the pressure of the fluid from the reeled tubing. The latter pressure thus builds up against the ball valve 69, and when this pressure is sufficient to exert a force sufficient to shear the pins 65, the sleeve 64 moves downwardly until the groove 64*b* aligns with the lugs 68. This permits the lugs 68 to move into the groove 64*b*, thus releasing the housing 62 from the housing 66 and permitting a quick disconnect of the housing 62 and therefore the reeled tubing 100 from the stinger assembly 60. It is understood that a plurality of circulating holes (not shown) are provided through the housing 62, which are axially aligned with, and angularly spaced from, the holes receiving the shear pins 65, to allow for circulation of fluid through the reeled tubing 100 while the latter is being removed from the well.

Removal of the housing 62 exposes the fishing neck 70 which allows a heavy duty workstring (not shown), which may include a pulling tool, an accelerator and a hydraulic jar, to be attached to a reeled tubing and lowered into the casing 20 until the pulling tool engages the fishing neck. Thus a pulling operation can be performed on the stinger assembly 60.

In the event it is desired to remove the assembly of the present invention from the casing 20, the above-described operation is reversed. Thus, the stinger assembly 60 is initially removed from the straddle assembly 30 by pushing down on the reeled tubing, and therefore the sleeve 88, to cause the sleeve to rotate against the pins 58 and align the slots 88*a* with the pins so that the sleeve 88, and therefore the stinger assembly, can be released from the straddle assembly by pulling up on the reeled tubing. A pulling tool (not shown) is then connected to the reeled tubing and lowered into the casing until it engages the fishing neck 42 of the locking mandrel assembly 32 to permit the straddle assembly 30 to be removed An example of a suitable pulling tool for the purpose is described in copending patent application Ser. No. 345,899, filed May 1, 1989, and assigned to the assignee of the present invention. During the lowering of the pulling tool, a prong associated with the pulling tool can move the valve 59 downwardly to equalize the pressure. The sleeve 26 of the valve 10 is then moved upwardly to its closed position by the shifting tool described above using reeled tubing. During this movement of the sleeve 26, it can be stopped in an intermediate position in which the raised portion 26*a* engages in the middle detent 14*d*. In this position, the passages 26*c* are in alignment with the opening 16*c* in the intermediate housing 16 to permit any well fluid to flow therethrough and equalize the pressure of the fluid. This is done when the sleeve 26 is closed, and equalization is needed prior to opening.

It is thus seen that the system, assembly and method of the present invention provide an efficient and reliable technique for directing stimulation fluid into and through the perforations in the casing 20 while effectively isolating same from leakage and preventing blowout.

It is understood that several variations can be made in the foregoing without departing from the scope of the invention. For example, even though the opening of the sliding side door and the setting of the straddle assembly was described as being done utilizing reeled tubing, these operations could also be performed using wireline.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluid flow control assembly comprising:

a. a sliding sleeve valve comprising:

(1) a tubular housing having a radial opening extending therethrough;

(2) means for connecting said housing in a wellbore tube; and (3) a sleeve extending within said housing and having a radial opening extending therethrough, said sleeve being slidable relative to said housing to and from a position in which said openings align;

b. a straddle assembly comprising:

(1) a mandrel having a radial opening extending therethrough;

(2) means for connecting said mandrel to a tool for inserting said mandrel in said housing with said opening in said mandrel in alignment with said opening in said housing; and (3) axially spaced sealing means supported on said mandrel and extending between, and in sealing engagement with, the outer surface of said mandrel and the inner surface of said housing; said opening in said mandrel extending between said sealing means; and (4) means for preventing the flow of said fluid axially through said mandrel; and c. a stinger assembly comprising:

(1) a tubular sub having a radial opening extending therethrough; and (2) means for connecting an end of said sub to reeled tubing for inserting at least a portion of said sub into said mandrel with said opening in said sub in alignment with said openings in said mandrel and said housing; and d. locking means associated with said mandrel and said sub for preventing axial movement between said mandrel and said sub;

e. whereby fluid flow is directed, by said packing means, through said aligned openings and between said reeled tubing and the space between said housing and said wellbore tube.

2. The assembly of claim 1 wherein said sealing means comprises first and second packing assemblies disposed in an axially-spaced relationship with said aligned openings extending between said packing assemblies.

3. The assembly of claim 1 further comprising packing means extending between, and in sealing engagement with, said mandrel and said sub.

4. The assembly of claim 1 wherein said housing has a bore for receiving said sleeve.

5. The assembly of claim 1 wherein said sleeve is slidable from said position for blocking flow of said fluid through said openings.

6. The assembly of claim 1 wherein said means for preventing fluid flow axially through said mandrel comprises an end cap disposed on the end of said mandrel.

7. The assembly of claim 1 further comprises equalizer valve means connected to said mandrel for selectively permitting or preventing well fluid to flow between the exterior and the interior of said mandrel.

8. The assembly of claim 1 further comprising valve means associated with said sub for controlling the flow of well fluid through said assembly.

9. The assembly of claim 1 wherein said means for connecting said sub to said reeled tubing comprises fluid pressure responsive means for disconnecting said reeled tubing from said sub.

10. The assembly of claim 1 where said locking means comprises a rotatable sleeve mounted on said sub and defining at least one groove, and a pin connected to said mandrel and extending in said groove.

11. A system for controlling fluid flow in a well comprising:

a. a casing disposed in an earth well and having perforations extending therethrough adjacent a formation in said earth well;

b. a string of well tubing;

c. upper and lower packers for sealing said tubing in said casing to form a sealed annular chamber between said casing and said tubing in communication with said formation;

d. a tubular sliding sleeve valve assembly connected in said tubing, extending between said packers and having a radial opening extending therethrough;

e. a tubular straddle assembly disposed in said sliding sleeve valve assembly and having a radial opening extending therethrough for alignment with said opening in said sleeve valve assembly;

f. sealing means extending between, and in sealing engagement with, the outer surface of said straddle assembly and the inner surface of said sleeve valve assembly; and g. a stinger assembly extending in said straddle assembly and connected to reeled tubing, said stinger assembly having a radial opening extending therethrough in alignment with said openings in said sleeve valve assembly and said straddle assembly;

h. whereby fluid flow is directed, by said sealing means, through said aligned openings and between said reeled tubing and said sealed annular chamber.

12. The system of claim 11 futher comprising locking means associated with said stinger assembly and said straddle assembly for preventing axial movement therebetween.

13. The system of claim 11 wherein said sleeve valve assembly comprises a tubular housing and a tubular sleeve extending within said housing and having a radial opening extending therethrough, said sleeve being slidable relative to said housing to and from a position in which said openings align.

14. The system of claim 13 wherein said sleeve is slidable from an open position to a position blocking flow of said fluid through said openings.

15. The system of claim 11 wherein said sealing means comprises first and second packing assemblies disposed in an axially spaced relationship and wherein said aligned openings extend between said packing assemblies.

16. The system of claim 11 further comprising packing means extending between, and in sealing engagement with, said straddle assembly and said stinger assembly.

17. The system of claim 11 further comprising an end cap disposed on the end of said straddle assembly for preventing the flow of fluid therethrough.

18. The system of claim 11 further comprises equalizer valve means connected to said straddle assembly for selectively permitting or preventing well fluid to flow between the exterior and interior of said straddle assembly.

19. The system of claim 11 further comprising valve means associated with said stinger assembly for controlling the flow of well fluid through said assembly.

20. The system of claim 11 further comprising fluid pressure responsive means for disconnecting said reeled tubing from said sub.

21. The system of claim 11 where said locking means comprises a rotatable sleeve mounted on said stinger assembly and defining at least one groove, and a pin connected to said straddle assembly and extending in said groove.

22. The system of claim 11 wherein said straddle assembly comprises a mandrel having said radial opening extending therethrough and means for connecting said mandrel to a tool for inserting said mandrel into said sleeve valve assembly.

23. The system of claim 11 wherein said stinger assembly comprises a tubular sub having said radial opening extending therethrough and means for connecting said sub to said reeled tubing.

24. A stinger assembly for locking in a tool, said stinger assembly comprising:

a. a tubular member having a radial opening extending therethrough;

b. means for connecting an end of said tubular member to reeled tubing for inserting at least a portion of said tubular member into said tool;

c. a locking sleeve supported on said tubular member and adapted to be engaged by a pin on said tool for preventing axial movement between said tubular member and said tool; and d. valve means associated with said tubular member for controlling the flow of well fluid through said assembly.

25. The assembly of claim 24 further comprising sealing means for extending between, and in sealing engagement with, said tubular member and said tool.

26. The assembly of claim 24 where said locking sleeve is rotatable and defines a plurality of grooves in which said pin extends.

27. A method of controlling the flow of fluid between reeled tubing and a wellbore tube, said method comprising the steps of:

a. including a sliding sleeve assembly valve in said wellbore tube, said sleeve valve assembly having a radial opening extending therethrough;

b. inserting a straddle assembly into said sleeve valve assembly with an opening in said straddle assembly in alignment with said opening in said sleeve valve assembly;

c. providing two spaced packings on said straddle assembly extending between, and in sealing engagement with, the outer surface of said straddle assembly and the inner surface of said sleeve valve assembly with said aligned openings extending between said packings;

d. connecting an end of a stinger assembly to said reeled tubing for inserting at least a portion of said stinger assembly into said straddle assembly with an opening in said stinger assembly in alignment with said aligned openings;

e. preventing the flow of said fluid axially through said straddle assembly; and f. locking said stinger assembly and said straddle assembly against relative axial movement;

g. whereby fluid flow is directed, by said packing means, through said aligned openings between said reeled tubing and the space between said housing and said wellbore tube.

28. The method of claim 27 further comprising the steps of selectively sliding a sleeve to and from a position where it blocks the flow of said fluid through said openings in said sleeve valve assembly.

29. The method of claim 27 further comprising the step of selectively permitting or preventing well fluid to flow between the exterior and interior of said straddle assembly.

30. The method of claim 27 further comprising the steps of disconnecting the reeled tubing from said stinger assembly.

31. A fluid flow control assembly comprising:

a. a tubular sliding sleeve valve assembly connected in a wellbore tube and having a radial opening extending therethrough;

b. a tubular straddle assembly for insertion into said sleeve valve assembly and having a radial opening extending therethrough for alignment with said opening in said sleeve valve assembly;

c. sealing means extending between, and in sealing engagement with, the outer surface of said straddle assembly and the inner surface of said sleeve valve assembly;

d. a stinger assembly for insertion into said straddle assembly and connected to reeled tubing, said stinger assembly having a radial opening extending therethrough in alignment with said openings in said sleeve valve assembly and said straddle assembly; and e. locking means associated with said stinger assembly and said straddle assembly for preventing axial movement therebetween;

f. whereby fluid flow is directed, by said sealing means, through said aligned openings and between said reeled tubing and the space between said sleeve valve assembly and said wellbore tube.

32. The assembly of claim 31 wherein said sleeve valve assembly comprises a tubular housing and a tubular sleeve extending within said housing and having a radial opening extending therethrough, said sleeve being slidable relative to said housing to and from a position in which said openings align.

33. The assembly of claim 32 wherein said sleeve is slidable from an open position to a position blocking flow of said fluid through said openings.

34. The assembly of claim 31 wherein said sealing means comprises first and second packing assemblies disposed in an axially-spaced relationship and wherein said aligned openings extend between said packing assemblies.

35. The assembly of claim 31 further comprising packing means extending between, and in sealing engagement with, said straddle assembly and said stinger assembly.

36. The assembly of claim 31 further comprising an end cap disposed on the end of said straddle assembly for preventing the flow of fluid therethrough.

37. The assembly of claim 31 further comprises equalizer valve means connected to said straddle assembly for selectively permitting or preventing well fluid to flow between the exterior and interior of said straddle assembly.

38. The assembly of claim 31 further comprising valve means associated with said stinger assembly for controlling the flow of well fluid through said assembly.

39. The assembly of claim 31 further comprising fluid pressure responsive means for disconnecting said reeled tubing from said sub.

40. The assembly of claim 31 where said locking means comprises a rotatable sleeve mounted on said stinger assembly and defining at least one groove, and a pin connected to said straddle assembly and extending into said groove.

41. The assembly of claim 31 wherein said straddle assembly comprises a mandrel having a radial opening extending therethrough and means for connecting said mandrel to a tool for inserting said mandrel into said sleeve valve assembly.

42. The assembly of claim 31 wherein said stinger assembly comprises a tubular sub having said radial opening extending therethrough and means for connecting said sub to said reeled tubing.

43. A stinger assembly for locking in a tool, said stinger assembly comprising:

a. a tubular member having a radial opening extending therethrough;

b. means for connecting an end of said tubular member to reeled tubing for inserting at least a portion of said tubular member into said tool and for responding to fluid pressure for disconnecting said reeled tubing from said tubular member; and c. a locking sleeve supported on said tubular member and adapted to be engaged by a pin on said tool for preventing axial movement between said tubular member and said tool.

44. The assembly of claim 43 further comprising sealing means for extending between, and in sealing engagement with, said tubular member and said tool.

45. The assembly of claim 43 further comprising valve means associated with said tubular member for controlling the flow of well fluid through said assembly.

46. The assembly of claim 43 where said locking sleeve is rotatable and defines a plurality of grooves in which said pin extends.

* * * * *

UNITED STATES PATENT AND TRADEMARK OFFICE

CERTIFICATE OF CORRECTION

PATENT NO. :5,012,871

DATED :May 7, 1991

INVENTOR(S) :Charles W. Pleasants, et al.

It is certified that error appears in the above-identified patent and that said Letters Patent is hereby corrected as shown below:

Col. 3, line 6, "ar" should be --are--.

Col. 4, line 10, "4" should be --46--.

Col. 8, line 41, "64 aof" should be --64a of--.

Claim 27, line 17, "including a sliding sleeve assembly valve in said" should be --including a sliding sleeve valve assembly in said--.

Signed and Sealed this

Twentieth Day of October, 1992

*Attest:*

DOUGLAS B. COMER

*Attesting Officer*

*Acting Commissioner of Patents and Trademarks*